US012800262B2

(12) United States Patent
Puha

(10) Patent No.: US 12,800,262 B2
(45) Date of Patent: Nov. 17, 2026

(54) HANDGUARD MOUNTING SYSTEM

(71) Applicant: Eight Holdings LLC, Coeur d'Alene, ID (US)

(72) Inventor: Teodor Puha, Coeur d'Alene, ID (US)

(73) Assignee: Eight Holdings, LLC, Couer d'Alene, ID (US)

( * ) Notice: Subject to any disclaimer, the term of this patent is extended or adjusted under 35 U.S.C. 154(b) by 0 days.

(21) Appl. No.: 19/074,705

(22) Filed: Mar. 10, 2025

(65) Prior Publication Data

US 2025/0283689 A1 Sep. 11, 2025

Related U.S. Application Data

(60) Provisional application No. 63/563,349, filed on Mar. 9, 2024.

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41C 27/00
See application file for complete search history.

(56) References Cited

U.S. PATENT DOCUMENTS

| | | | | |
|---|---|---|---|---|
| 8,037,633 | B1 * | 10/2011 | Troy | F41C 23/16 42/75.01 |
| 9,335,117 | B2 * | 5/2016 | Miller | F16B 39/04 |
| 10,302,388 | B1 * | 5/2019 | Brown | F41C 23/16 |
| 10,386,149 | B1 * | 8/2019 | Facchini | F41A 5/26 |
| 10,401,122 | B2 * | 9/2019 | Williams | F41G 11/003 |
| 10,436,549 | B1 * | 10/2019 | Taylor | F41C 23/16 |
| 12,018,907 | B1 * | 6/2024 | Noonan | F41C 23/16 |
| 12,146,725 | B2 * | 11/2024 | Olsen | F41C 23/16 |
| 2017/0097207 | A1 * | 4/2017 | Hines | F41C 23/16 |
| 2017/0115094 | A1 * | 4/2017 | Gagnon | F41C 23/16 |
| 2018/0356181 | A1 * | 12/2018 | Williams | F41C 23/16 |
| 2023/0324140 | A1 * | 10/2023 | Olsen | F41A 3/66 42/72 |

* cited by examiner

*Primary Examiner* — Benjamin P Lee
(74) *Attorney, Agent, or Firm* — Mark A. Pitchford; Eric B. Fugett; Pitchford Fugett, PLLC

(57) ABSTRACT

A handguard mounting system including a receiver having a tenon on which is defined a plurality of tenon lugs and a handguard having an open rear end in which the tenon is receivable. The handguard includes a plurality of handguard lugs on an interior surface of the open rear end. The tenon lugs and the handguard lugs cooperate to mount the handguard to the receiver when the tenon is received in the open rear end of the handguard and a top of the handguard is rotationally aligned around the tenon with a top of the receiver. One of the handguard or the receiver can include a latch configured to be selectably engaged with the other one of the handguard or the receiver to deter rotation of the handguard about the tenon when the top of the handguard is rotationally aligned around the tenon with the top of the receiver.

20 Claims, 17 Drawing Sheets

HANDGUARD MOUNTING SYSTEM

CROSS-REFERENCES TO RELATED APPLICATIONS

This non-provisional patent application claims priority to U.S. Provisional Patent Application Ser. No. 63/563,349, filed Mar. 9, 2024 and titled "HANDGUARD MOUNTING SYSTEM", the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The invention relates generally to guns having a handguard. More particularly, the invention pertains to guns having a handguard that surrounds a barrel and is mounted to a receiver of the gun. Known handguard mounting interfaces for mounting a handguard onto a receiver of a gun (including but not limited to air guns and firearms in rifle, pistol, and shotgun configurations) typically require the use of fasteners that extend through the handguard to either screw or clamp the handguard onto a portion of the receiver. The usage of fasteners can be time-consuming and cumbersome, especially when field stripping the gun, because fasteners must be secured using special tools and specific torque requirements. Fasteners can also decrease the durability and the service life of the interface because fasteners inherently create unwanted stress points. Additional problems, including decreased reliability of the gun's sights, may also result from strained or otherwise improperly secured fasteners. Accordingly, what is needed are improvements in handguard mounting systems for guns.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

Aspects of the disclosure provide a handguard mounting system for a gun. The handguard mounting system includes a receiver with a tenon that has a plurality of tenon lugs extending outwardly therefrom. The handguard mounting system also includes a handguard with an open rear end thereof in which the tenon is receivable. The handguard includes a plurality of handguard lugs on an interior surface of the open rear end. The tenon lugs and the handguard lugs cooperate to prevent longitudinal movement of the handguard relative to the receiver when the tenon is received in the open rear end of the handguard and a top of the handguard is rotationally aligned around the tenon with a top of the receiver. Upon rotating and longitudinally moving the handguard relative to the receiver, the corresponding lugs can selectably and mechanically lock or unlock the handguard to the receiver.

In some embodiments, cooperation of the tenon lugs and the handguard lugs, and thus rotational alignment of the top of the receiver with the top of the handguard, can be maintained by a latch. The latch can be movably mounted to one of the handguard or the receiver and configured to be selectably engaged with the other one of the handguard or the receiver to deter rotation of the handguard about the tenon when the top of the handguard is rotationally aligned around the tenon with the top of the receiver.

In one aspect, a handguard mounting system includes a receiver having a tenon on which is defined a plurality of tenon lugs and a handguard having an open rear end in which the tenon is receivable. The handguard includes a plurality of handguard lugs on an interior surface of the open rear end. The tenon lugs and the handguard lugs cooperate to mount the handguard to the receiver when the tenon is received in the open rear end of the handguard and a top of the handguard is rotationally aligned around the tenon with a top of the receiver.

In another aspect, a method of mounting a handguard for a gun to a receiver for the gun includes an initial step of providing a receiver with lugs and a handguard with lugs. The method further includes the steps of inserting the tenon into the open rear end of the handguard and rotationally aligning the top of the handguard around the tenon with the top of the receiver.

In another aspect, a handguard mounting system includes a receiver having a tenon on which is defined a plurality of tenon lugs and a handguard having an open rear end in which the tenon is receivable. The handguard includes a plurality of handguard lugs on an interior surface of the open rear end. The tenon lugs and the handguard lugs cooperate to prevent longitudinal movement of the handguard relative to the receiver when the tenon is received in the open rear end of the handguard and a top of the handguard is rotationally aligned around the tenon with a top of the receiver. The handguard mounting system further includes a latch on one of the handguard or the receiver configured to be selectably engaged with the other one of the handguard or the receiver to deter rotation of the handguard about the tenon when the top of the handguard is rotationally aligned around the tenon with the top of the receiver.

In another aspect, a method of mounting a handguard for a gun to a receiver for the gun includes an initial step of providing a handguard with lugs and a receiver with lugs. The method further includes inserting the tenon into the open rear end of the handguard and rotationally aligning the top of the handguard around the tenon with the top of the receiver. The method further includes a step of engaging the latch with the other one of the handguard or the receiver.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

The details of one or more embodiments of the disclosure are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the disclosure are discussed in detail below, it should be appreciated that the disclosure provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the disclosure. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 4:
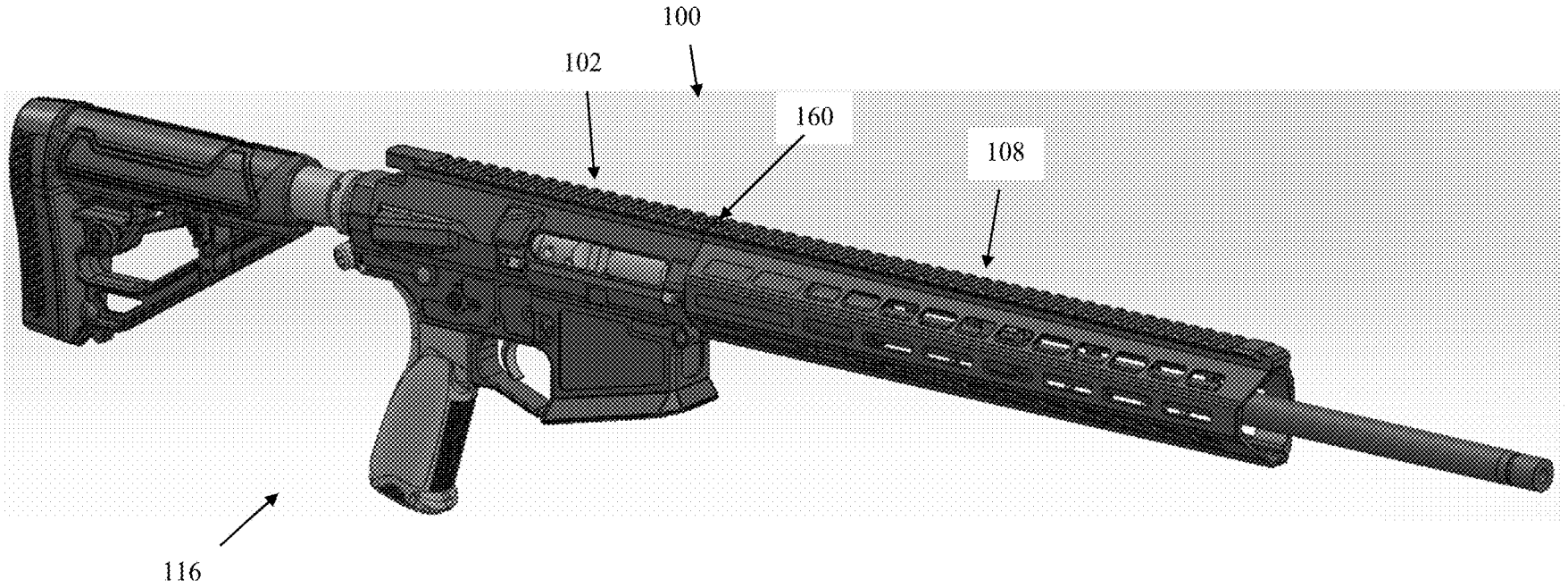
FIG. 4 is an elevated front right side perspective view of a gun in the form of a gas operated AR platform rifle equipped with a handguard mounting system constructed in accordance with an embodiment of the present invention.
Figure 15:
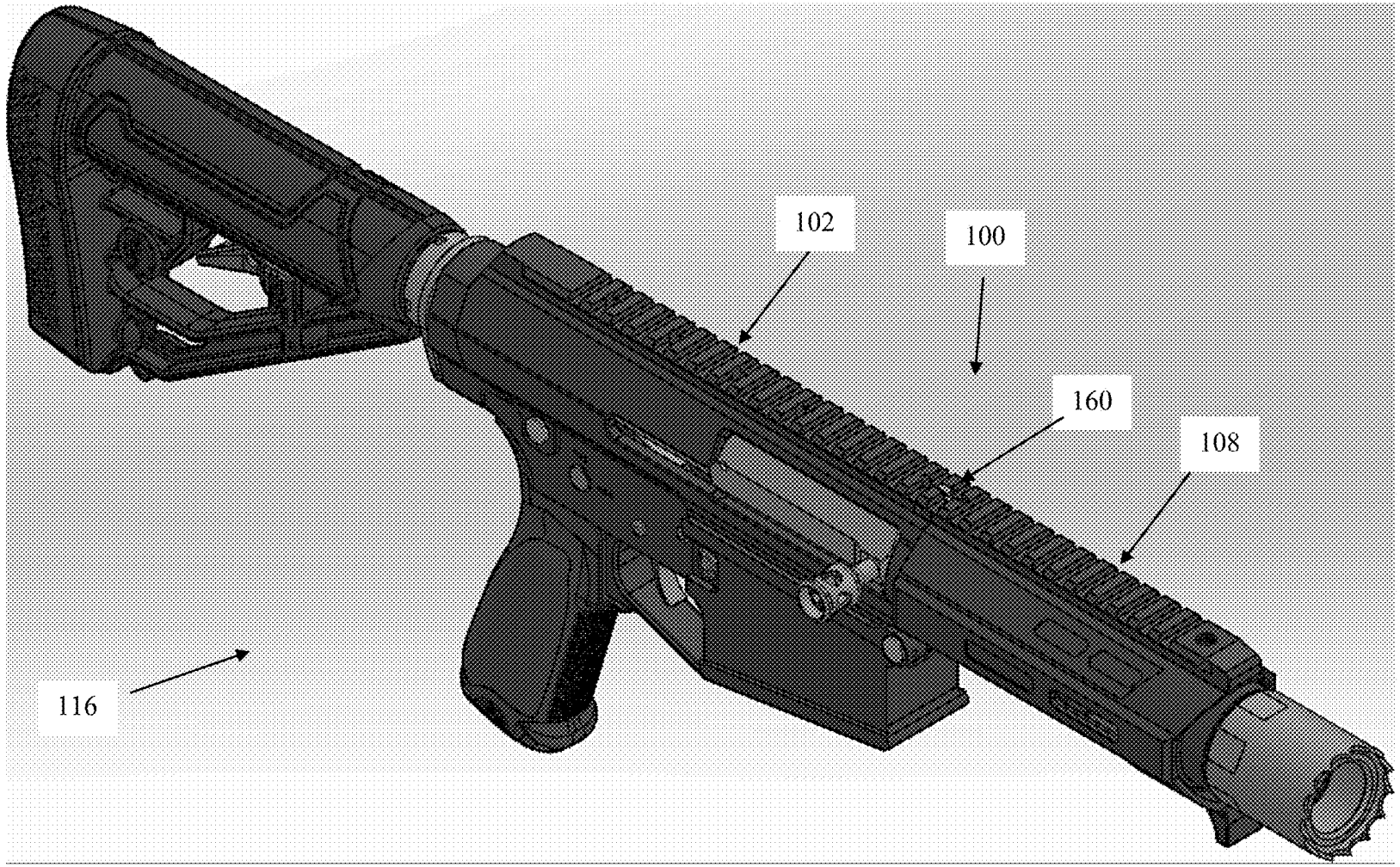
FIG. 15 is an elevated front right side perspective view of a gun in the form of a shotgun equipped with a handguard mounting system constructed in accordance with an embodiment of the present invention.
Figure 16:
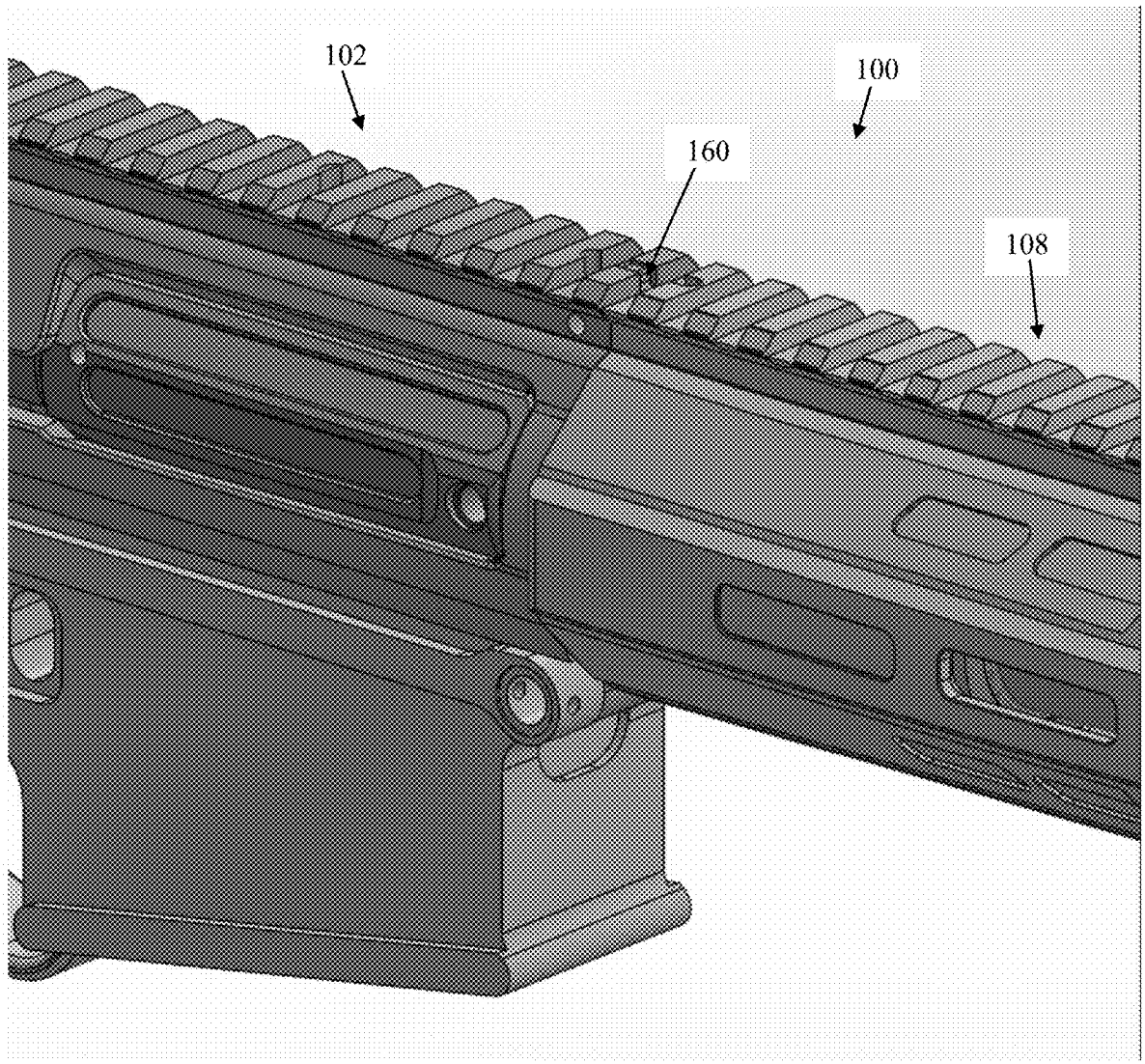
FIG. 16 is an elevated front right side perspective detail view of the handguard mounting system of FIG. 15 showing the handguard securely mounted to the receiver with the top of the handguard rotationally aligned about the tenon with the top of the receiver and latch in the locked position. The charging handle is omitted for clarity.
Figure 17:
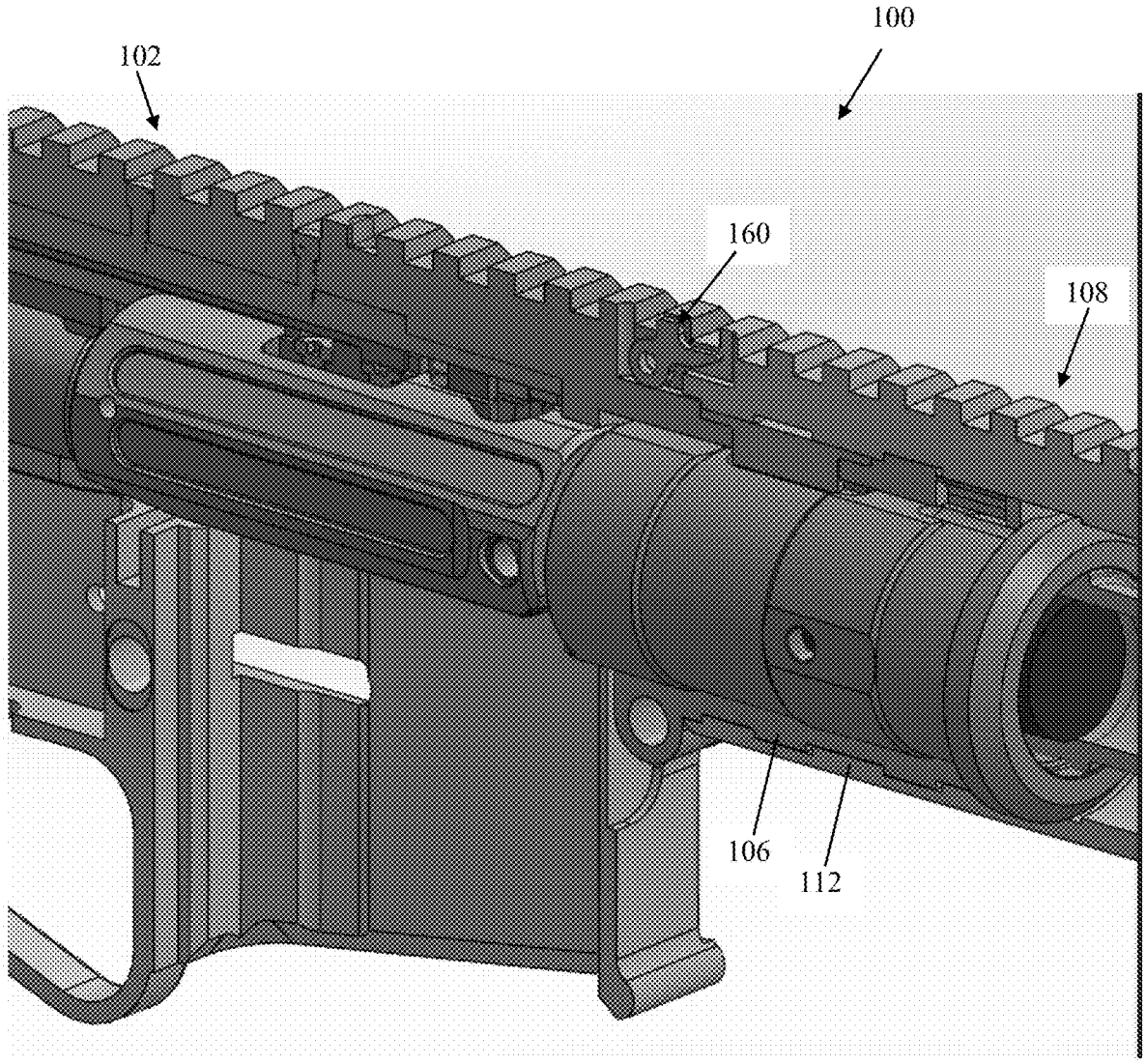
FIG. 17 is a partial cutaway view of the objects of FIG. 16.
Figure 18:
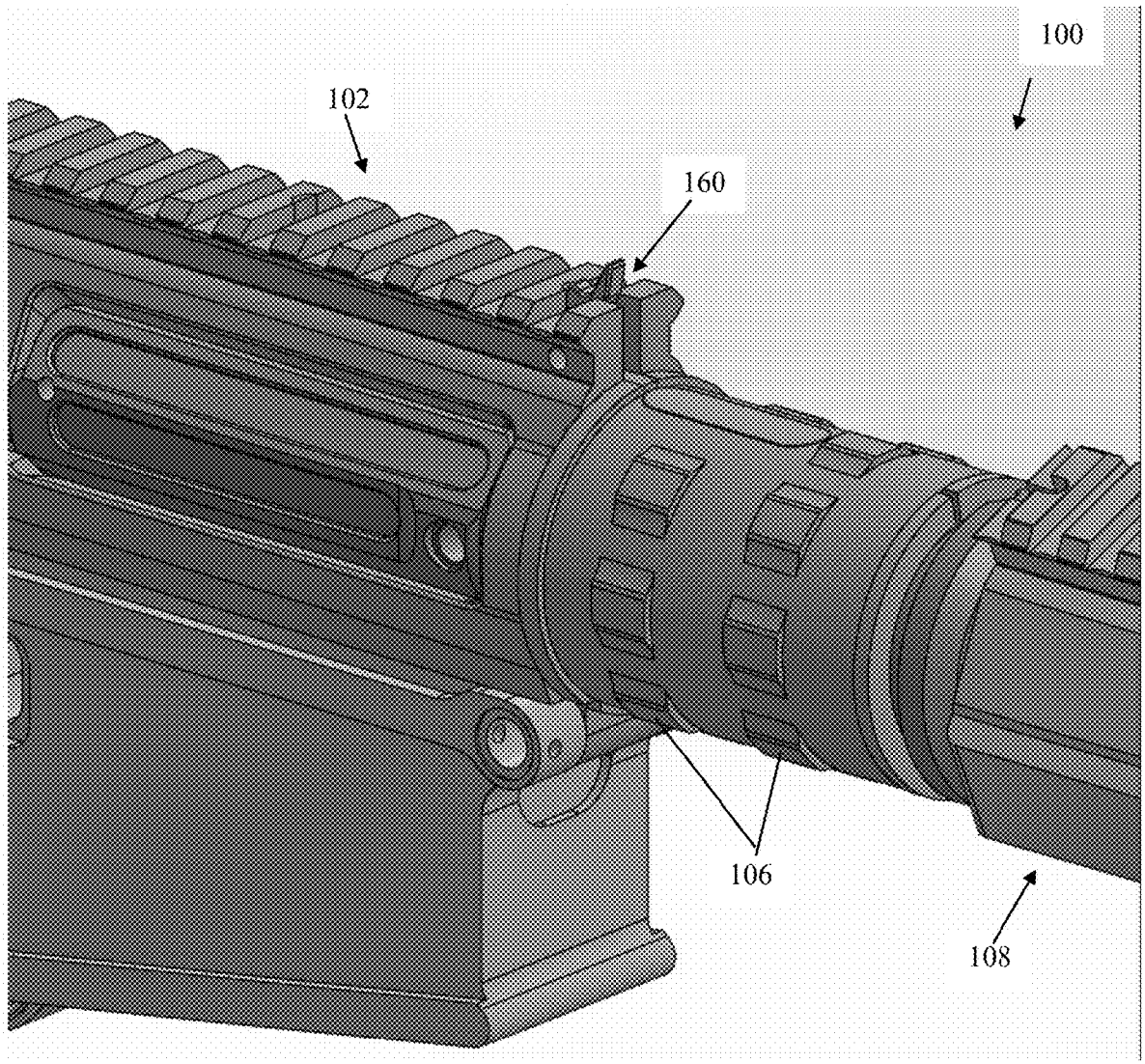
FIG. 18 is an elevated front right side perspective view of the handguard mounting system of FIG. 15 showing the latch in the unlocked position and the handguard translated longitudinally forward along the tenon and disconnected from the receiver.

As described herein, an "upright" position is considered to be the position of apparatus components while in proper operation or in a natural resting position as described and shown herein, for example, in FIGS. 4 and 15. The upright firing position of a firearm is a generally level firing position. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use. The term "longitudinally spaced" can mean axially spaced along a longitudinal axis of a gun.

As used herein, the terms "front" and "forward" means in a direction extending toward the muzzle of the gun. In some cases, the term "forward" can also mean forward beyond the muzzle of the gun. The terms "aft" and "rear" means in a direction extending away from the muzzle of the gun toward a rear end of a gun. In some cases, the term "rearward" can also mean rearward beyond the rear end of the gun.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The terms "significantly", "substantially", "approximately", "about", "relatively," or other such similar terms that may be used throughout this disclosure, including the claims, are used to describe and account for small fluctuations, such as due to variations in manufacturing or processing from a reference or parameter, whether the reference or parameter is explicitly specified or is generally considered normal or possible within the limits of applicable industry-accepted manufacturing practices and tolerances. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

The terms "coupled" and "connected" mean at least either a direct electrical or mechanical connection between the connected items or an indirect connection through one or more passive or active intermediary devices.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Figure 1:
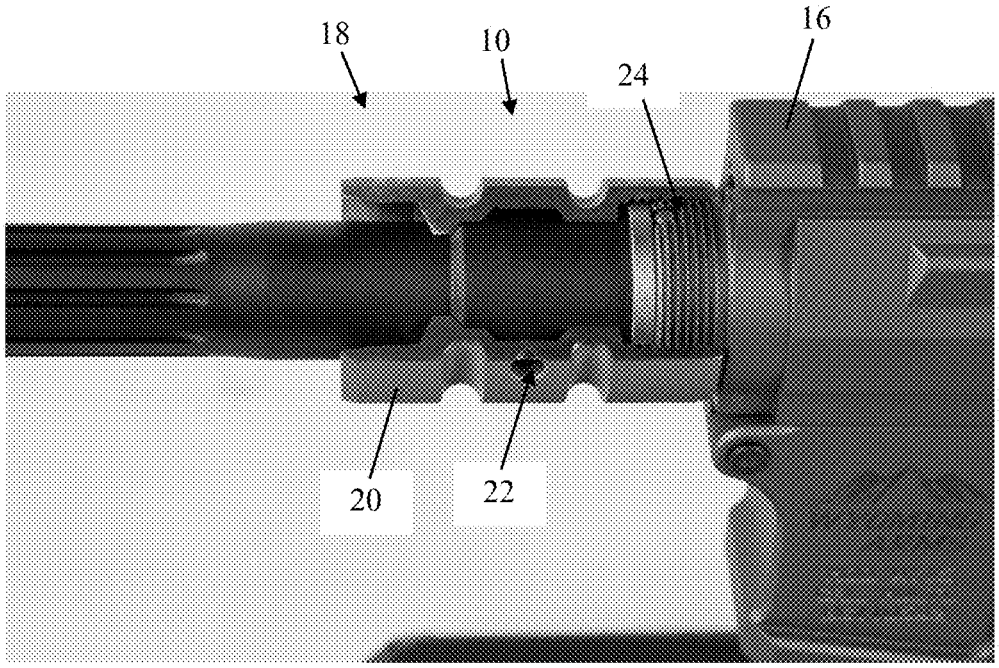
FIG. 1 (PRIOR ART)
FIG. 1 is a perspective side cutaway view of a PRIOR ART handguard mounting interface wherein the handguard is mounted onto a barrel nut that is threaded onto a receiver.
Figure 2:
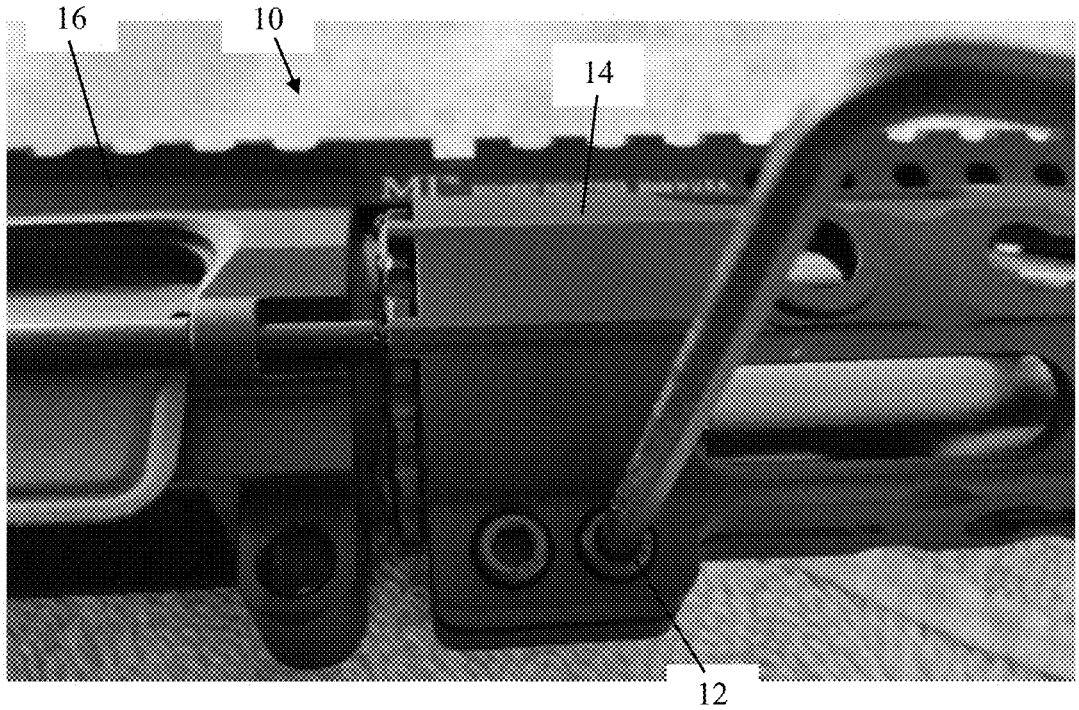
FIG. 2 (PRIOR ART)
FIG. 2 is a perspective side view of another PRIOR ART handguard mounting interface wherein the handguard is clamped onto the receiver via fasteners.
Figure 3:
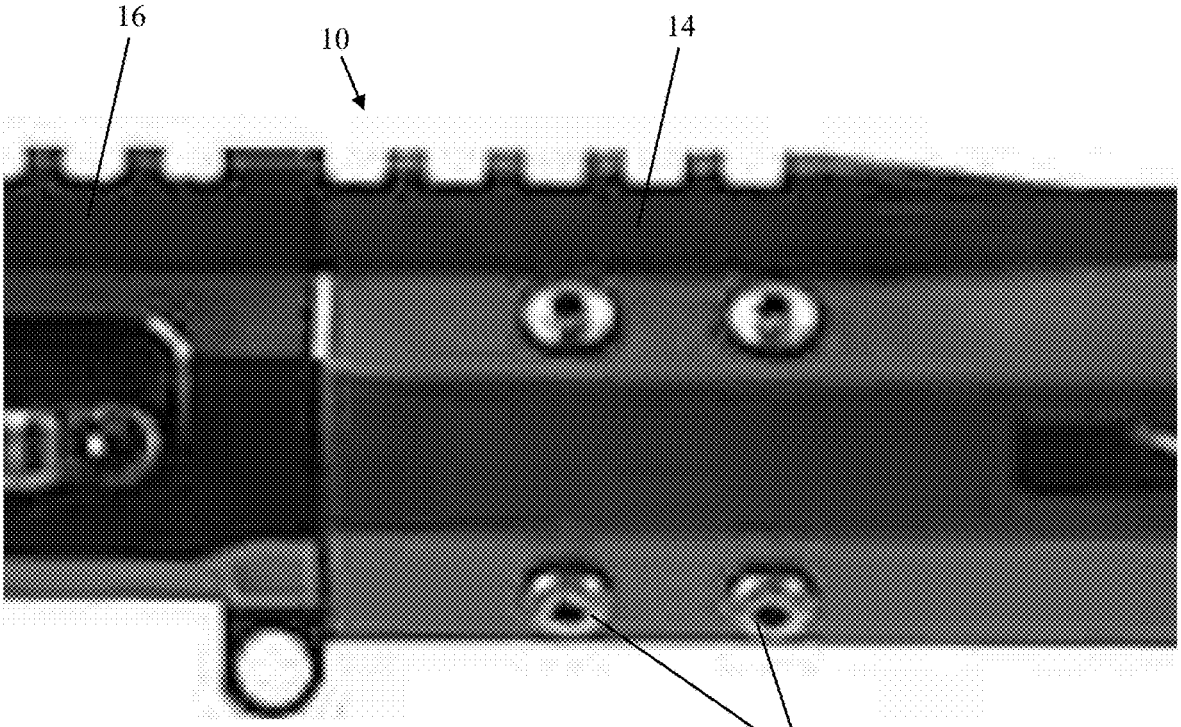
FIG. 3 (PRIOR ART)
FIG. 3 is a perspective side view of another PRIOR ART handguard mounting interface wherein the handguard is secured directly to the body of the receiver via fasteners.

Referring to FIGS. 1-3, there is shown various prior art handguard mounting interfaces 10 that require the usage of fasteners 12 to mount a handguard 14 onto a receiver 16 (e.g., an upper receiver) of a gun 18. FIG. 1 illustrates a free-floating handguard mounting interface 10 wherein a handguard (not shown) is fastened directly onto a barrel nut 20 via fasteners 12 which thread into threaded fastener holes 22 in the barrel nut 20. The barrel nut 20 is threaded onto a threaded tenon 24 of the receiver 16. The attachment point between the barrel nut 20 and the receiver 16 is a relatively weak attachment point because only a small portion of the receiver 16 supports the barrel nut 20. Hence, upon attaching the handguard to the barrel nut 20 via the fasteners 12, the handguard is also poorly supported. FIG. 2 illustrates a clamp-on prior art handguard mounting interface 10 wherein the barrel nut 20 does not include fastener holes 22 and the handguard 14 is clamped onto the receiver 16 via fasteners 12 at the bottom of the handguard 14. FIG. 3 illustrates a prior art handguard mounting interface 10 wherein the handguard 14 is fastened directly onto the body of the receiver 16 via fasteners 12 that extend through the handguard 14 and screw into corresponding holes within the receiver body. Due to the required use of fasteners 12 to mount the handguard 14, such prior art handguard mounting interfaces 10 create stress points (at the fasteners 12) that hinder durability and the service life of the interface 10, require specific torque requirements and specific tools, such as torque wrenches, require an adhesive, such as threadlockers (making field stripping or servicing much more difficult), and cause secondary issues such as hampering the gun's sights because of the inherent lack of rigidity in securing fasteners 12. Additionally, especially for higher caliber platforms, the handguards may become loose due to the strained or improperly secured fasteners 12.

Referring to FIGS. 4-14, there is shown a gun in the form of a gas operated AR platform rifle equipped with a handguard mounting system 100 constructed in accordance with an embodiment of the present invention. The handguard mounting system 100 includes a receiver 102 having a body 130 and a tenon 104 on which is defined a plurality of tenon lugs 106, and a handguard 108 with an open rear end 110 having a corresponding plurality of handguard lugs 112 defined on an interior surface 114 thereof. The tenon 104 extends forwardly from a forward end of the receiver body 130 and defines a longitudinal axis 136 of the receiver 102. The tenon 104 is receivable in the open rear end 110 of the handguard 108. The handguard 108 is received against the forward end of the receiver body 130 when the tenon 104 is received in the open rear end 110 of the handguard 108. When the tenon 102 is received in the open rear end 110 of the handguard 108 and a top 142 of the handguard 108 is rotationally aligned about the tenon 104 with a top 132 of the receiver 102, the handguard lugs 112 cooperate with (i.e., mechanically engage, as explained in more detail below) the tenon lugs 106 to prevent longitudinal movement of the handguard 108 relative to the receiver 102 and thereby mount the handguard 108 to the receiver 102. A latch 160 on the receiver 102 is then selectably actuatable to engage a portion of the handguard 108 and thereby secure the handguard 108 to the receiver 102 by deterring rotation of the handguard 108 about the tenon 104. It is to be understood, however, that although the latch 160 is depicted in the figures as being mounted to the receiver 102 and configured to selectably engage a portion of the handguard 108, in some embodiments, the latch 160 can alternatively be mounted to the handguard 108 and configured to selectably engage a portion of the receiver 102.

The handguard mounting system 100 is essentially a locking mechanism for mounting the handguard 108 to the receiver 102 of a gun 116. Importantly, the handguard mounting system 100 is usable with any desired gun 116 or other weapon that uses a handguard 108. For example, in some embodiments, the gun 116 can be an air gun or a firearm configured as a rifle, a pistol, or a shotgun. In some embodiments, the gun 116 can be a grenade launcher, a less-lethal projectile launcher, or any other projectile launching weapon having a handguard that mounts to a receiver. As shown in FIGS. 4-14, the gun 116 is a gas operated AR platform rifle with a barrel 118 extending through the tenon 104, a gas tube 120, and a gas block (not shown). A top portion of the tenon 104 includes a groove 122 (FIG. 5) configured to receive a gas tube 120 extending the full length thereof, and the handguard 108 includes a widened groove 124 at the top of the open rear end 110 (FIG. 6) configured to accommodate the gas tube 120 during mounting and dismounting of the handguard 108. In some embodiments, the gun 116 is not a gas operated rifle and grooves 122, 124 can be omitted.

In comparison to prior art handguard mounting interfaces 10, which require fasteners 12 and mounting bracketry, the novel handguard mounting system 100 of the instant invention reduces the number of parts that are required to securely mount the handguard 108 to the receiver 102. This makes the gun 116 more easily field strippable and makes the handguard 108 readily removable without the need of tools (e.g., Allen wrench, torque wrench). The omission of fasteners (e.g., screws) also beneficially reduces stress points. The handguard mounting system 100 also provides significantly more contact surface area between the handguard 108 and the receiver 102, which yields a more robust construction that increases rigidity, durability, and overall strength of the attachment therebetween. The area of attachment includes nearly the full outer surface area of the tenon 104, which mates with the interior surface 114 of the open rear end 110 of handguard 108, as well as certain surfaces of the complimentary tenon and handguard lugs 106, 112, respectively, which mechanically engage one another to prevent longitudinal movement of the handguard 108 away from the receiver body 130. This better maintains the concentricity of the handguard 108 with the barrel 118 (FIG. 9) and increases reliability and repeatability of handguard attachment, which in turn provides improvements in consistency of sight accuracy (e.g., front-end sights, such as iron sights, lasers, or other optics) and shot placement.

Figure 5:
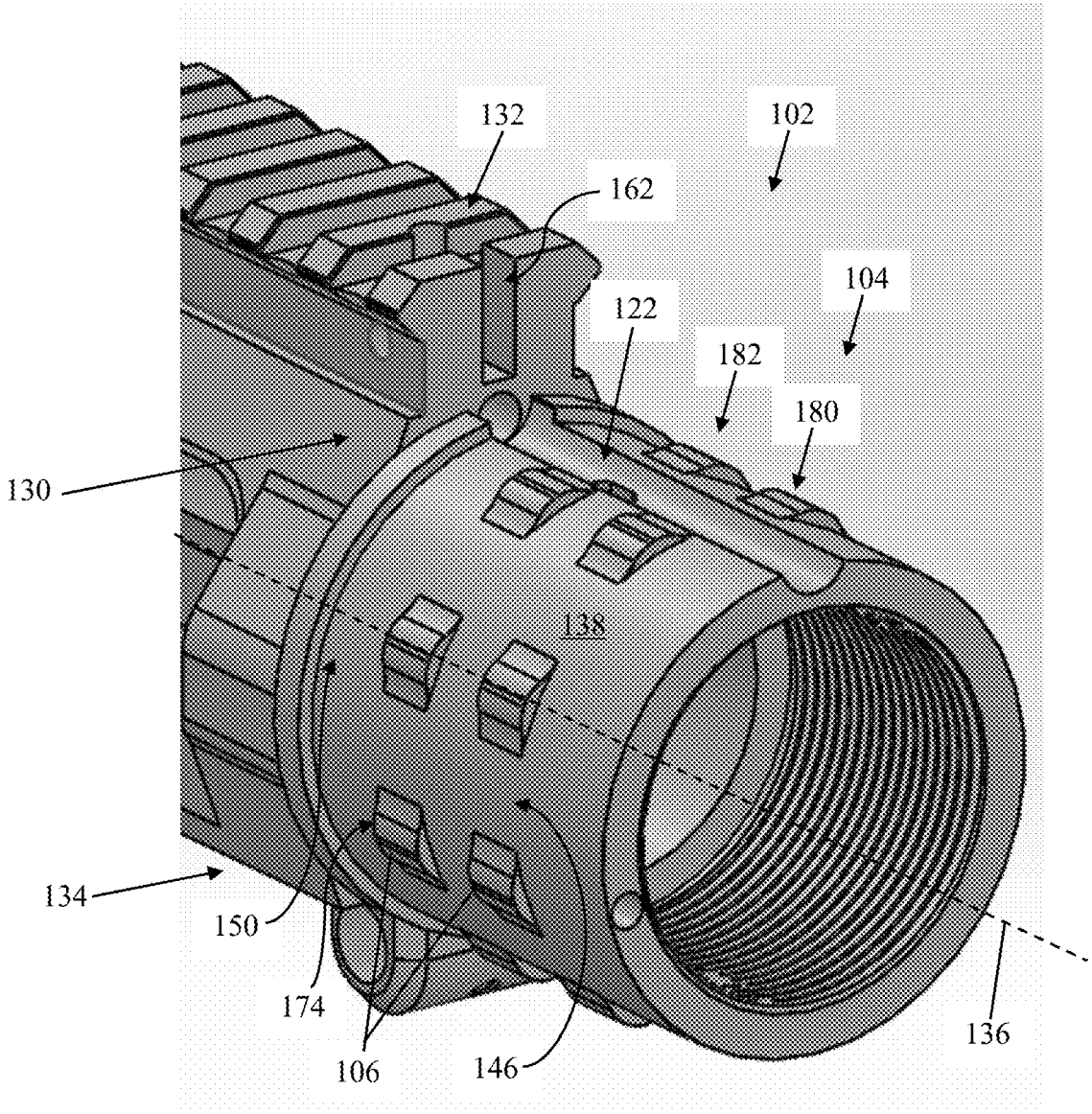
FIG. 5 is an elevated front right side perspective view of a front end of the receiver of the handguard mounting system of FIG. 4 showing a plurality of tenon lugs circumferentially disposed about the tenon at front end of the receiver.

Referring to FIG. 5, the receiver 102 includes a receiver body 130 having a top 132 and a bottom 134 opposite the top 132. The tenon 104 protrudes forwardly from a forward end of the receiver body 130. The tenon 104 defines a longitudinal axis 136 of the receiver 102. The tenon 104 can be integrally formed with the receiver body 130. The tenon lugs 106 are spaced circumferentially around and extend radially outward from an outer surface 138 of the tenon 104.

Figure 6:
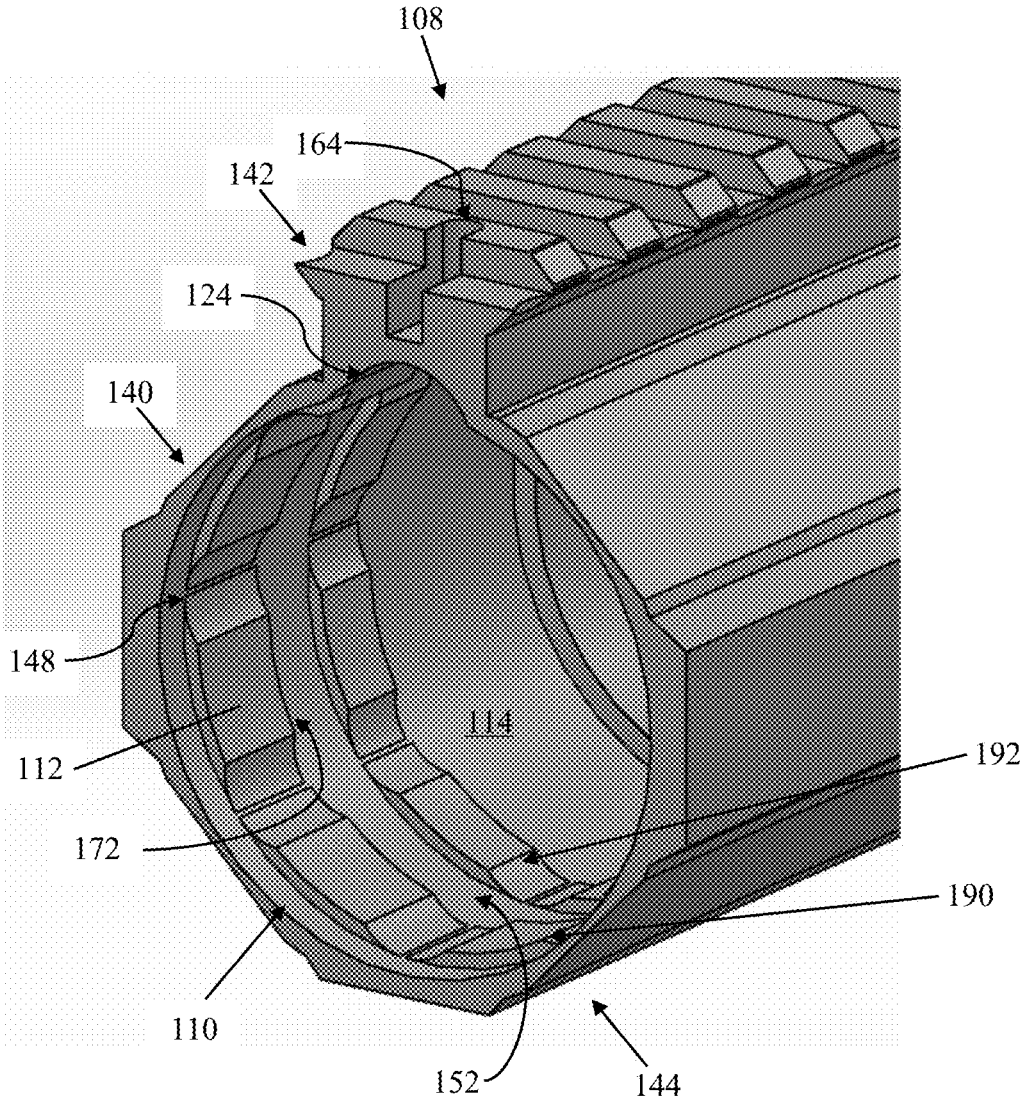
FIG. 6 is an elevated rear right side perspective view of an open rear end of the handguard of the handguard mounting system of FIG. 4 showing a plurality of handguard lugs on the interior surface of the open rear end.

Referring to FIG. 6, the handguard 108 includes a handguard body 140 having a top 142 and a bottom 144 opposite the top 142. In one example, the top 132 of the receiver 102 and the top 142 of the handguard 108 define a continuous rail 132, 142, such as a picatinny rail. In rotationally aligning the top 142 of the handguard 108 with the top 132 of the receiver 102, the handguard 108 is rotationally indexed to the receiver 102 (e.g., wherein the tops 132, 142 rest substantially flush with one another and form a continuous rail). The handguard lugs 112 are spaced circumferentially around and protrude centripetally (i.e., inwardly) from the interior surface 114 of the open rear end 110 of the handguard 108. The tenon 104 is receivable in the handguard 108 through the open rear end 110. The handguard body 140 is received against the forward end of the receiver body 130 when the tenon 104 is received in the open rear end 110 of the handguard 108.

In one embodiment, the lugs of the receiver 102 are circumferentially spaced apart from one another at an arcuate distance about the circumference of the tenon 104, thus defining handguard lug keyways 146 (or gaps or channels) that extend longitudinally along the tenon 104 between adjacent tenon lugs 106. The handguard lug keyways 146 are sized to receive the handguard lugs 112 therethrough. The handguard lugs 112 are likewise circumferentially spaced apart from one another at an arcuate distance about the circumference of the interior surface 114 of the open rear end 110 of the handguard 108 so as to define tenon lug keyways 148 (or gaps or channels) extending longitudinally along the interior surface 114 of the open rear end 110 of the handguard 108 between adjacent handguard lugs 112. The tenon lug keyways 148 are sized to receive the tenon lugs 106 therethrough. The tenon and handguard lugs 106, 112, and handguard and tenon lug keyways 146, 148 are complementary to one another in that the handguard lugs 112 can pass through the handguard lug keyways 146 on the tenon 104, and the tenon lugs 106 can pass through the tenon lug keyways 148 on the handguard 108 when the tenon 104 is inserted into or removed from the open rear end 110 of the handguard 108 during assembly or disassembly of the mounting system 100. As such, when the tenon and handguard lugs 106, 112 are aligned with the respective handguard and tenon lug keyways 146, 148, the handguard 108 is free to translate longitudinally along the tenon 104 (and the longitudinal axis 136) onto or off of the receiver 102. However, when the tenon 102 is received in the open rear end 110 of the handguard 108 and the top 142 of the handguard 108 is rotationally aligned about the tenon 104 with the top 132 of the receiver 102, a forward surface 172 of each handguard lug 112 mechanically engages a rear surface 174 of each tenon lug 106 to prevent the tenon 104 from being removed from the open rear end 110 of the handguard 108. In this way, the handguard lugs 112 longitudinally overlap the tenon lugs 106. The tenon 104 and handguard 108 also define circumferential (i.e., annular) gaps or channels 150, 152 around the outer surface of the tenon 104 and the interior surface 114 of the open rear end 110 of the handguard 108, respectively, through which the corresponding handguard lugs 112 and tenon lugs 106 may pass (once the handguard 108 is received against the front end of the tenon body 130) during rotation of the handguard 108 about the tenon 104 to align the top 142 of the handguard 108 with the top 132 of the receiver 102.

In one embodiment, the handguard mounting system 100 further includes a selectably lockable latch 160 configured to rotationally lock the handguard 108 relative to the receiver 102. The latch 160 is pivotably mounted in a mounting slot or recess 162 defined in the receiver body 130 proximate the tenon 104. The latch 160 is selectably receivable within a corresponding slot or recess 164 in the body of the handguard 108 to rotationally lock the handguard 108 relative to the receiver 102 and thus prevent the handguard 108 from rotating about the tenon 104 of the receiver 102. The latch 160 is thus movable between a locked position (see e.g., FIGS. 7 and 9) wherein the latch 160 is received within a slot or recess 164 in the body of the handguard 108, and an unlocked position (see e.g., FIG. 12) wherein the latch 160 is not received within the slot or recess 164 in the body of the handguard 108.

When in the locked position, the latch 160 deters or prevents the handguard 108 from rotating about the tenon 104 relative to the receiver 102 and, in combination with the cooperating tenon lugs 106 and handguard lugs 112 that simultaneously prevent longitudinal displacement of the handguard 108 relative to the receiver 102, functions to index and rigidly secure or lock the handguard 108 to the receiver 102. As such, the latch 160 can be said to function like a cross bar by preventing rotation of the handguard 108 about the tenon 104 when in the locked position. When in the unlocked position, the latch 160 does not deter or prevent the handguard 108 from rotating about the tenon 104 relative to the receiver 102, which in turn permits the handguard 108 to rotate freely about the tenon 104 of the receiver 102 so that the handguard 108 can be mounted on or removed from the tenon 104.

In one embodiment, the latch 160 takes the form of a pivotable lever 160. The lever 160 includes a lever body 166 that is pivotably mounted within the slot 162 of the receiver body 130 about a pivot pin (unnumbered). The lever 160 further includes a spur 168 protruding from the lever body 166 which is shaped and sized to be receivable within the slot 164 of the handguard body 140 to deter rotation of the handguard 108 about the tenon 104 when the latch 160 is in the locked position. The latch 160 is configured to remain in the locked position (i.e., maintain the spur 168 in the slot 164) until the latch 160 is manually moved to the unlocked position. In one embodiment, the lever body 166 can define a camming surface 170 configured to maintain the spur 168 in the slot 164 when the lever 160 is in the locked position until the spur 168 is manually lifted out of the slot 164 to move the lever 160 to the unlocked position. The camming surface 170 can be an arcuate surface that engages a bottom wall of the slot 162 in which the lever body 166 is pivotably mounted when the spur 168 is received in the slot 164 of the handguard (i.e., in the locked position). The latch 160 is manually movable by the user between the locked and unlock positions. As used herein, the term "manually" can include operation by hand or using a hand tool. Put differently, the user can move the latch 160 between the locked and unlock positions by hand or using a hand tool such as a screw driver, blade, or other narrow implement. In one embodiment, when in the locked position, the latch 160 can rest completely within the aligned slots 162, 164 in the receiver body 130 and the handguard body 140. This protects the latch 160 from becoming inadvertently bumped or knocked out of the locked position and into the unlocked position.

As noted above, it is to be understood that although the latch 160 is depicted in FIGS. 4-18 as being pivotably mounted to the receiver 102 and configured to selectably engage a slot 164 in the handguard 108, in other embodiments, the latch 160 can alternatively be pivotably mounted to the slot 164 in the handguard 108 and configured to selectably engage the groove or slot 162 in the receiver body 130. It should also be understood that the possible forms of the locking latch disclosed herein need not mirror that of the lever 160 depicted in the figures. For example, in some embodiments not specifically illustrated herein, the latch 160 can alternatively take the form of a manually actuatable plunger that is mounted to one or the other of the receiver 102 or the handguard 108. In such embodiments, a retractable portion of the plunger is receivable in a corresponding hole or depression defined in the other one of the receiver 102 or the handguard 108. Additional latching mechanisms will be apparent to those of ordinary skill in the art. All such latching mechanisms are considered within the scope of the invention as set forth in the claims.

Figure 7:
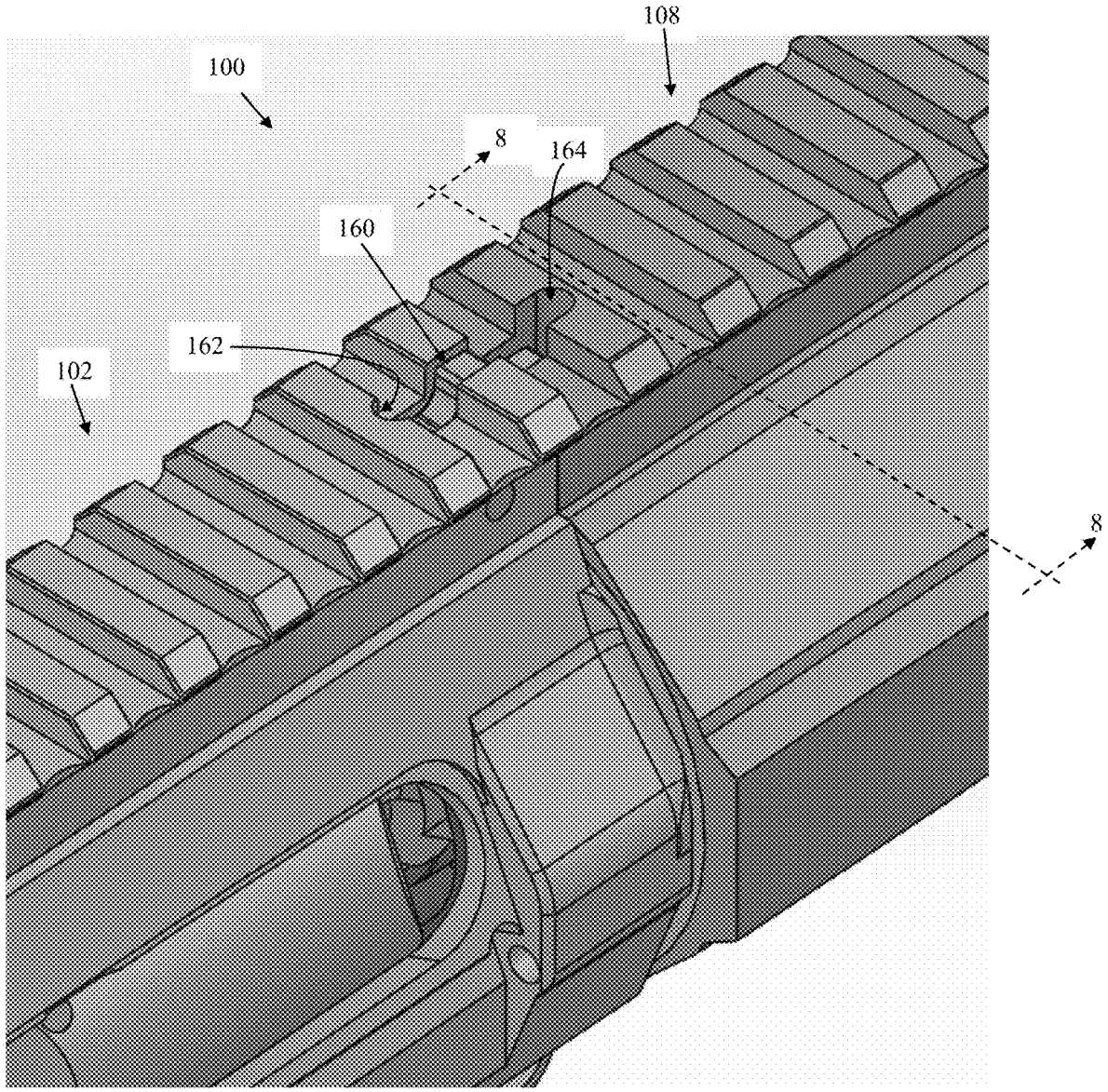
FIG. 7 is an elevated right side perspective detail view of the handguard mounting system of FIG. 4 showing the handguard securely mounted to the receiver with the top of the handguard rotationally aligned about the tenon with the top of the receiver and latch in the locked position.
Figure 8:
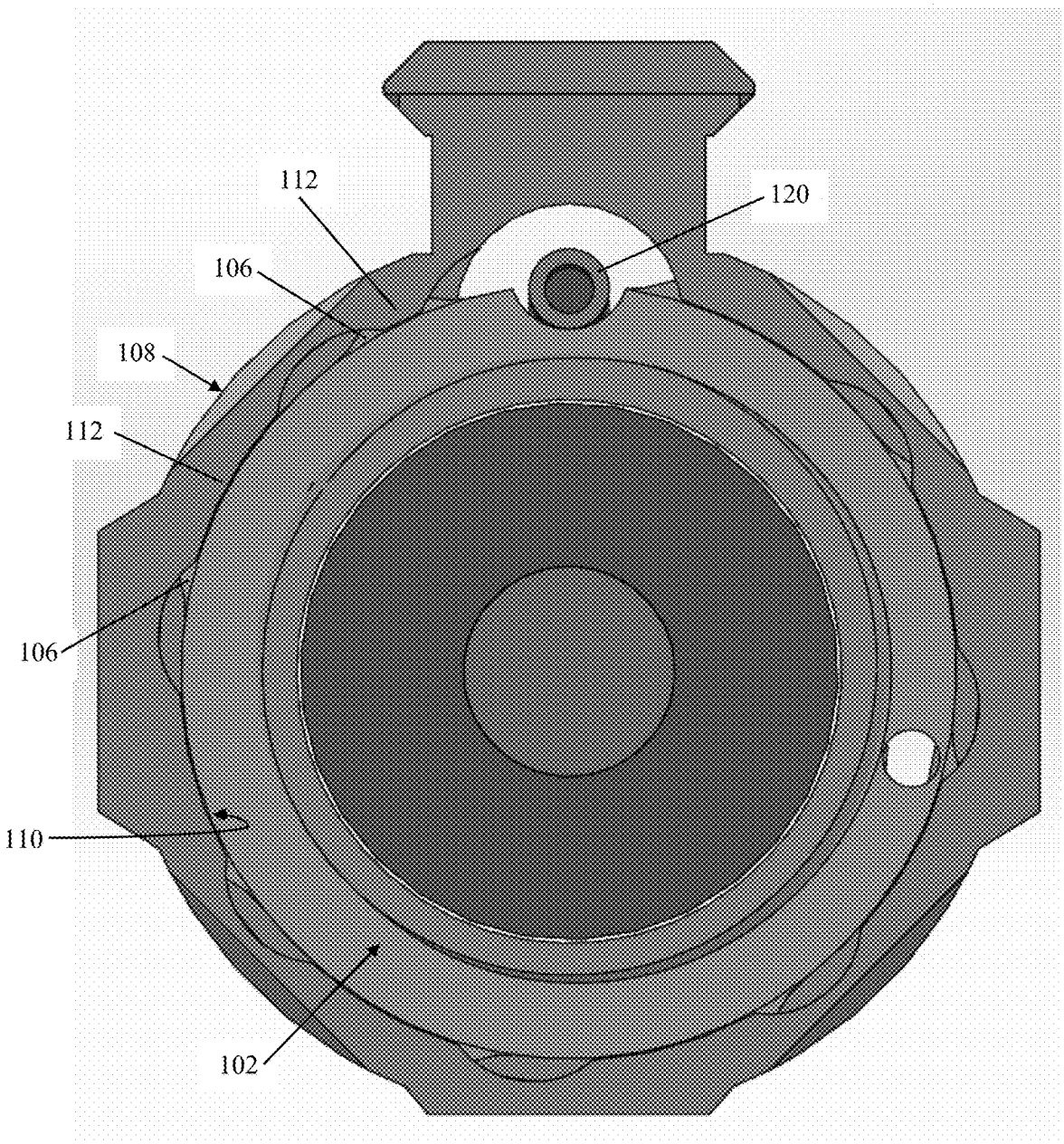
FIG. 8 is a sectional view of the objects of FIG. 7 taken along line 8-8. The handguard lugs cooperate with and mechanically engage the tenon lugs to prevent the handguard from being longitudinally displaced along the tenon and thereby separated from the receiver.
Figure 9:
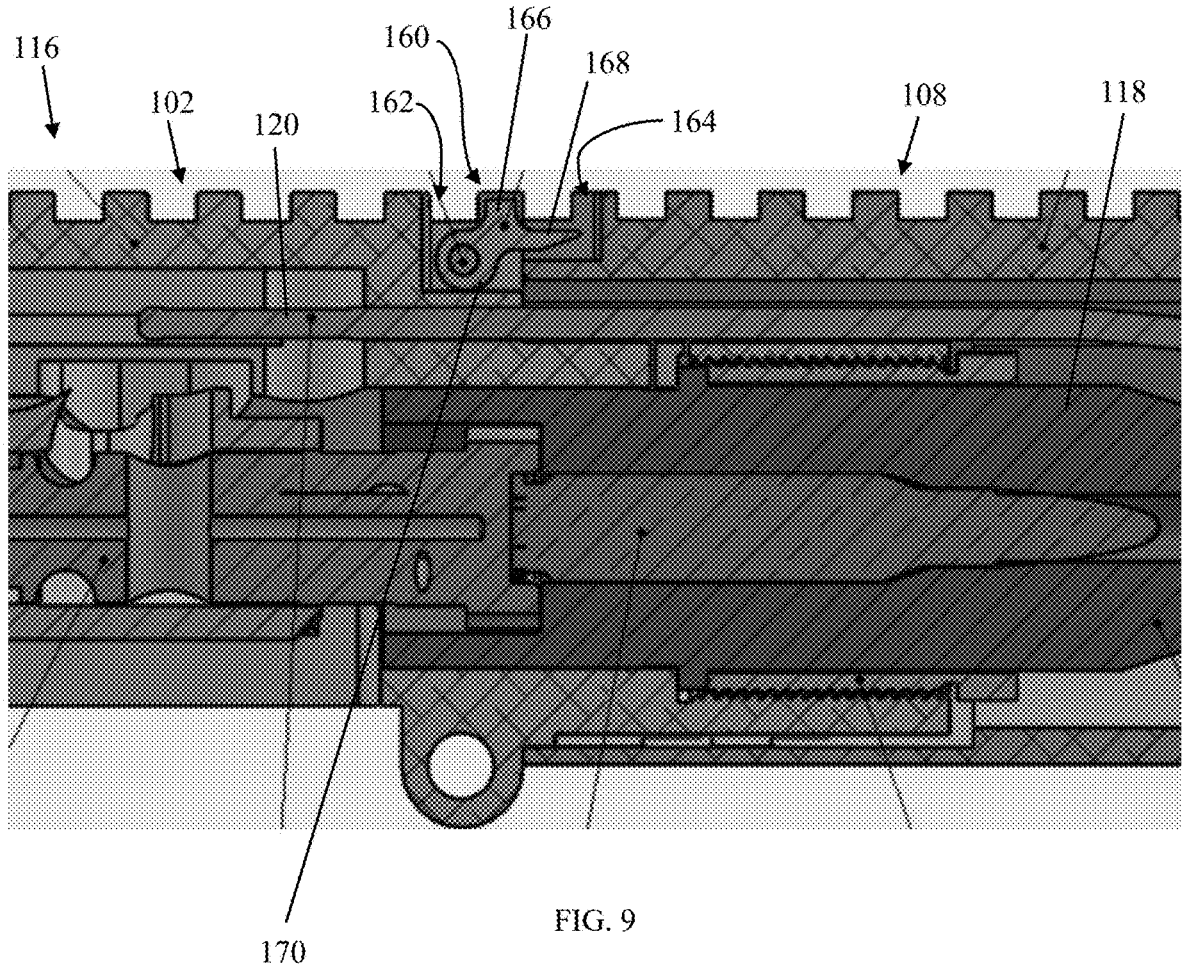
FIG. 9 is a right side longitudinal sectional view of the objects of FIG. 7.

FIGS. 7-9 illustrate a locked or working position of the handguard mounting system 100, wherein the tenon 104 is fully seated within the open rear end 110 of the handguard 108, the tops 132, 142 of the receiver 102 and handguard 108 are rationally aligned (FIG. 7), and the latch 160 is engaged to prevent the handguard 108 from rotating relative to the receiver 102 (FIG. 9). In the locked position, the handguard 108 is received against the forward end of the receiver body 130 when the tenon 104 is received in the open rear end 110 of the handguard 108 (such that the handguard 108 butts against the receiver body 130). As shown in FIG. 8, in the locked position, the lugs 106, 112 are misaligned from the keyways 146, 148 and engaged with one another, preventing the handguard 108 from moving longitudinally relative to the receiver 102 (e.g., moving linearly forward along the longitudinal axis 136 and separating from the receiver 102). In more detail, the engagement of the tenon lugs 106 and the handguard lugs 112 prevents longitudinal movement of the handguard 108 relative to the receiver 102 when the handguard 108 is received against the receiver 102, with the tenon 104 received in the open rear end 110 of the handguard 108, and the top 142 of the handguard 108 is rotationally aligned with the top 132 of the receiver 102. Thereby, the lugs 106, 112 cooperate (e.g., engage) to prevent the handguard 108 from moving longitudinally off the tenon 104, and the latch 160 prevents the handguard 108 from rotating to a position where the lugs 106, 112 are disengaged to allow the handguard 108 to be pulled off the tenon 104. Said differently, the latch 160 in tandem with the lugs 106, 112, rotationally and linearly fix the handguard 108 relative to the receiver 102, because the latch 160 in the locked position, prevents any rotational movement of the handguard 108 which in turn maintains lug engagement (i.e., preventing a rotation necessary for lug disengagement or lug-keyway alignment). In the locked position, the handguard body 140 of the handguard 108 completely covers and protects the lugs 106, 112.

In some embodiments, one or both of the pluralities of tenon lugs 106 and handguard lugs 112 can be configured to bias the handguard 108 into contact with the receiver body 130 when the tenon 104 is received in the open rear end 110 of the handguard 108 and the top 142 of the handguard 108 is rotationally aligned around the tenon 104 with the top 132 of the receiver 102. For example, in some embodiments, one or both of the pluralities of tenon lugs 106 and handguard lugs 112 can be angled relative to the longitudinal axis 136 of the tenon 104. In embodiment, at least one plurality of the plurality of tenon lugs 106 and the plurality of handguard lugs 112 can be at least partially helical relative to the longitudinal axis of the tenon 104. Consequently, when the tenon 104 is received in the open rear end 110 of the handguard 108 and the top 142 of the handguard 108 is rotationally aligned around the tenon 104 with the top 132 of the receiver 102, cooperation of the helical tenon lugs 106 and/or handguard lugs 112 can bias or translate the handguard rearwardly along the tenon 104 like screw threads.

In embodiments wherein one or both of the pluralities of tenon lugs 106 and handguard lugs 112 are angled or helical, the handguard 108 can be rotatable about the tenon 104 in only one of a clockwise direction or a counterclockwise direction to rotationally align the top 142 of the handguard 108 with the top 132 of the receiver 102 and thus mount the handguard 108 to the receiver 102. In other embodiments wherein the pluralities of tenon lugs 106 and handguard lugs 112 are not angled or helical, the handguard 108 can be rotatable about the tenon 104 in either of a clockwise direction and a counterclockwise direction to rotationally align the top 142 of the handguard 108 with the top 132 of the receiver 102 and thus mount the handguard 108 to the receiver 102.

In one embodiment, the tenon lugs 106 of the receiver 102 and the handguard lugs 112 of the handguard 108 include multiple circumferential rows of lugs 180, 182, 190, 192, respectively (FIGS. 5 and 6). For example, the tenon 104 includes a first row 180 and a second row 182 of tenon lugs 106 spaced longitudinally rearward on the tenon 104 from the first row 180 of tenon lugs 106. Similarly, the handguard 108 includes a first row 190 and a second row 192 of handguard lugs 112 spaced longitudinally forward on the interior surface 114 from the first row 190 of handguard lugs 112. The space or distance between rows 180, 182, 190, 192 of lugs 106, 112 (which defines the circumferential channels 150, 152) can be approximately equal to or slightly larger than a width of the corresponding lug 106, 112 which is receivable in the channel 150, 152. In one embodiment, each plurality of tenon lugs 106 and handguard lugs 112 includes only a single row of lugs 106, 112. In other embodiments, each plurality of tenon lugs 106 and handguard lugs 112 can include two or more rows lugs 106, 112. In one embodiment, the widths of all of the tenon lugs 106 and handguard lugs 112 are approximately equal.

In one embodiment, each handguard lug 112 is longer than each tenon lug 106. For example, each handguard lug 112 extends further around the interior surface 114 of the open rear end 110 of the handguard 108 than each tenon lug 106 extends around the outer surface 138 of the tenon 104. The use of longer handguard lugs 112 increases the contact or mating surface area between the handguard lugs 112 and the outer surface 138 of the tenon 104, which thereby reduces wear, increases rigidity and durability, and further increases the service life of the handguard mounting system 100. In alternate embodiments, each tenon lug 106 can be longer than each handguard lug 112. In some embodiments, the tenon lugs 106 and the handguard lugs 112 can be substantially equal in length. As can be appreciated, the lengths and surface profiles of the lugs 106, 112 can determine the tolerances between the handguard 108 and the receiver 102, when linearly moving and/or rotating the handguard 108 relative to the receiver 102.

In one embodiment, each tenon lug 106 can have a substantially cylindrical cross section and a tapered at each lateral end. The tapered lateral ends create a seamless intersection with the outer surface 138 of the tenon 104. In one embodiment, the shape of the handguard lugs 112 can correspond to the shape and size of the outer surface 138 of the tenon 104 and the tenon lugs 106. In an example, each handguard lug 112 can have concave and tapered lateral ends that correspond to the shape of the tenon lugs 106 and a concave middle section that corresponds to the shape of the outer surface 138 of the tenon 104.

Figure 10:
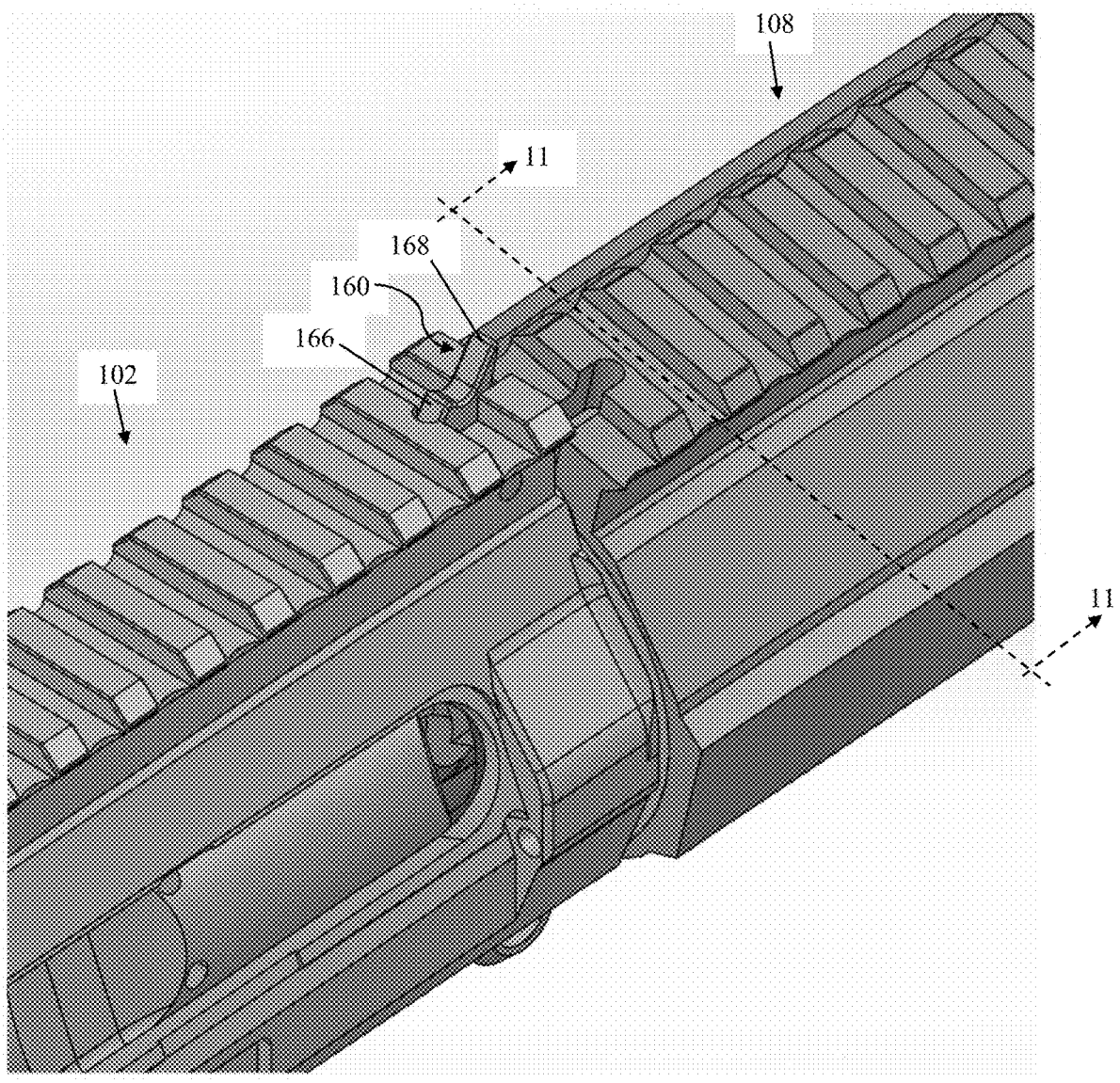
FIG. 10 is an elevated right side perspective detail view of the handguard mounting system of FIG. 4 showing the latch in the unlocked position and the handguard rotated about the tenon to an intermediate position wherein the handguard lugs do not cooperate with or mechanically engage the tenon lugs to prevent the handguard from being longitudinally displaced along the tenon and thereby removed from the receiver.
Figure 11:
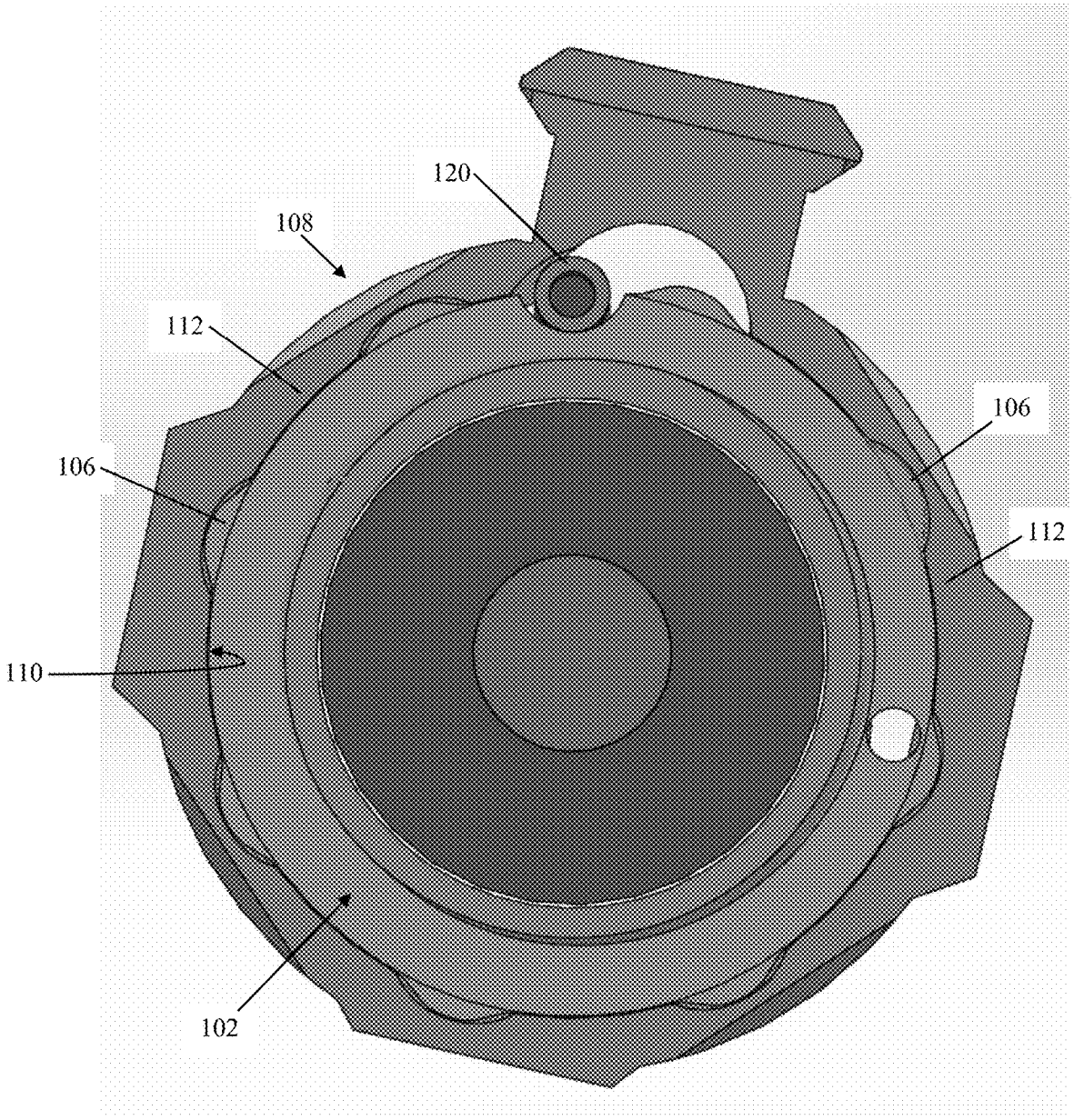
FIG. 11 is a sectional view of the objects of FIG. 10 taken along line 11-11 showing the handguard lugs aligned with a plurality of handguard lug keyways and the tenon lugs aligned with a plurality of tenon lug keyways so that the handguard is removable from the receiver upon forward longitudinal translation of the handguard along the tenon.
Figure 12:
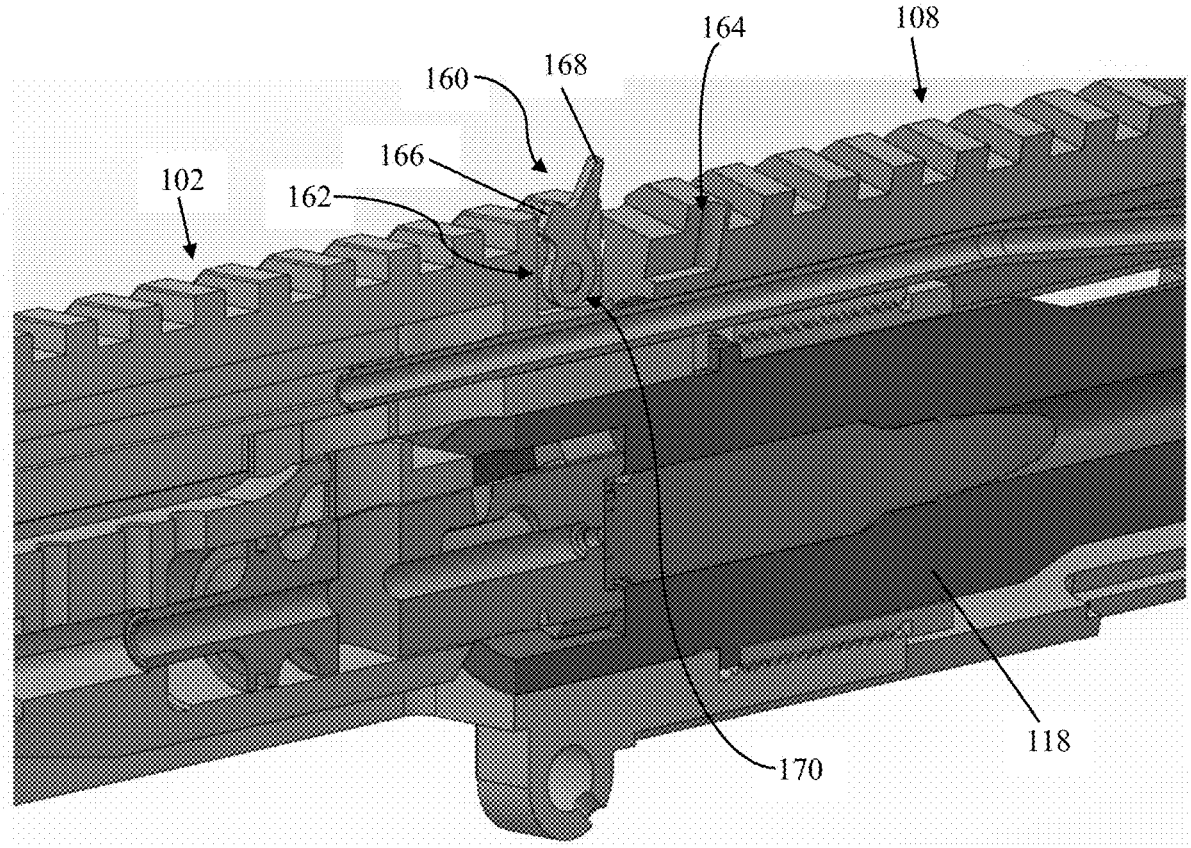
FIG. 12 is an elevated right side perspective longitudinal sectional view of the objects of FIG. 10.
Figure 13:
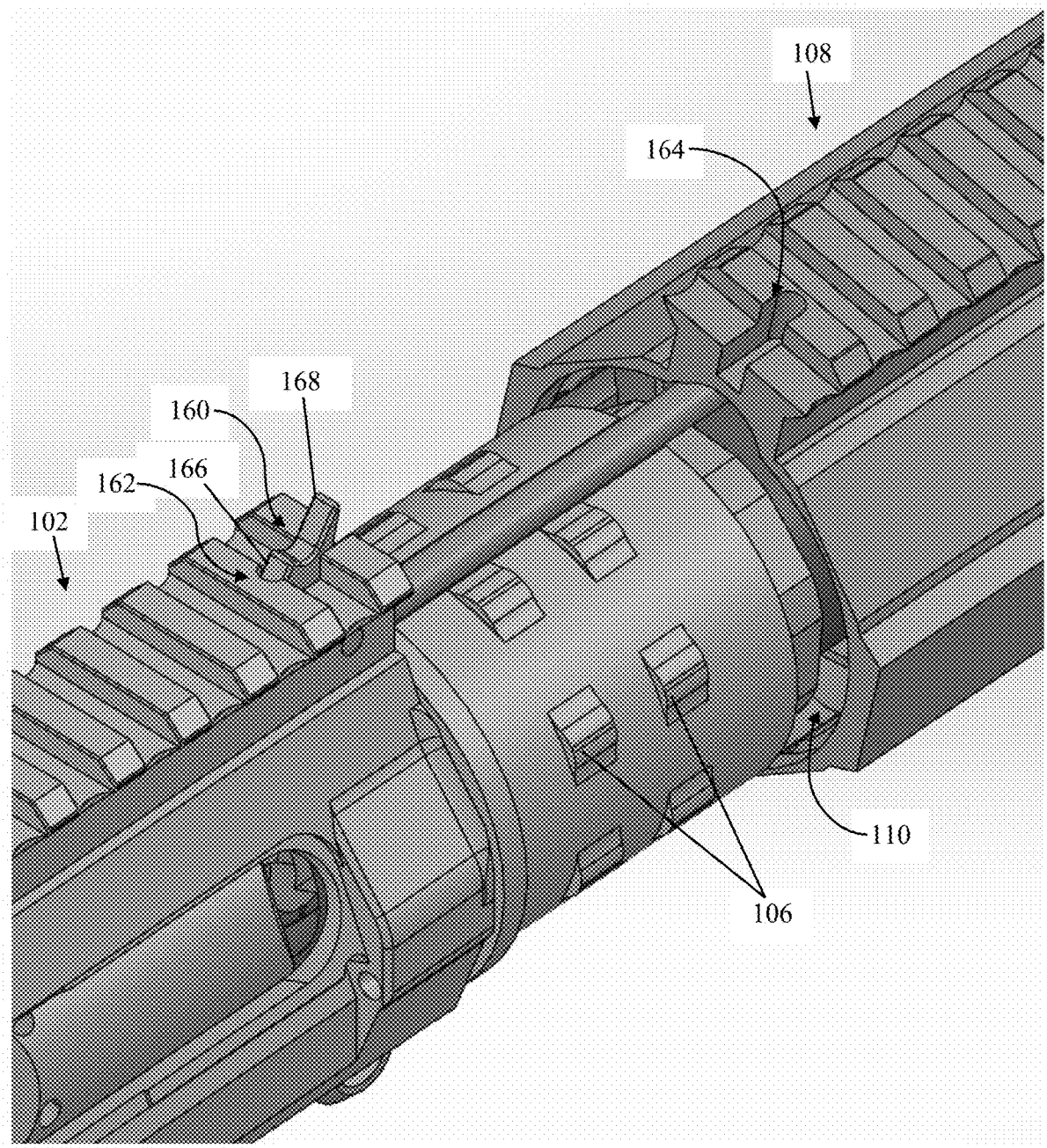
FIG. 13 is an elevated rear right side perspective detail view of the objects of FIG. 10 showing the handguard translated longitudinally forward along the tenon for separation from the receiver.
Figure 14:
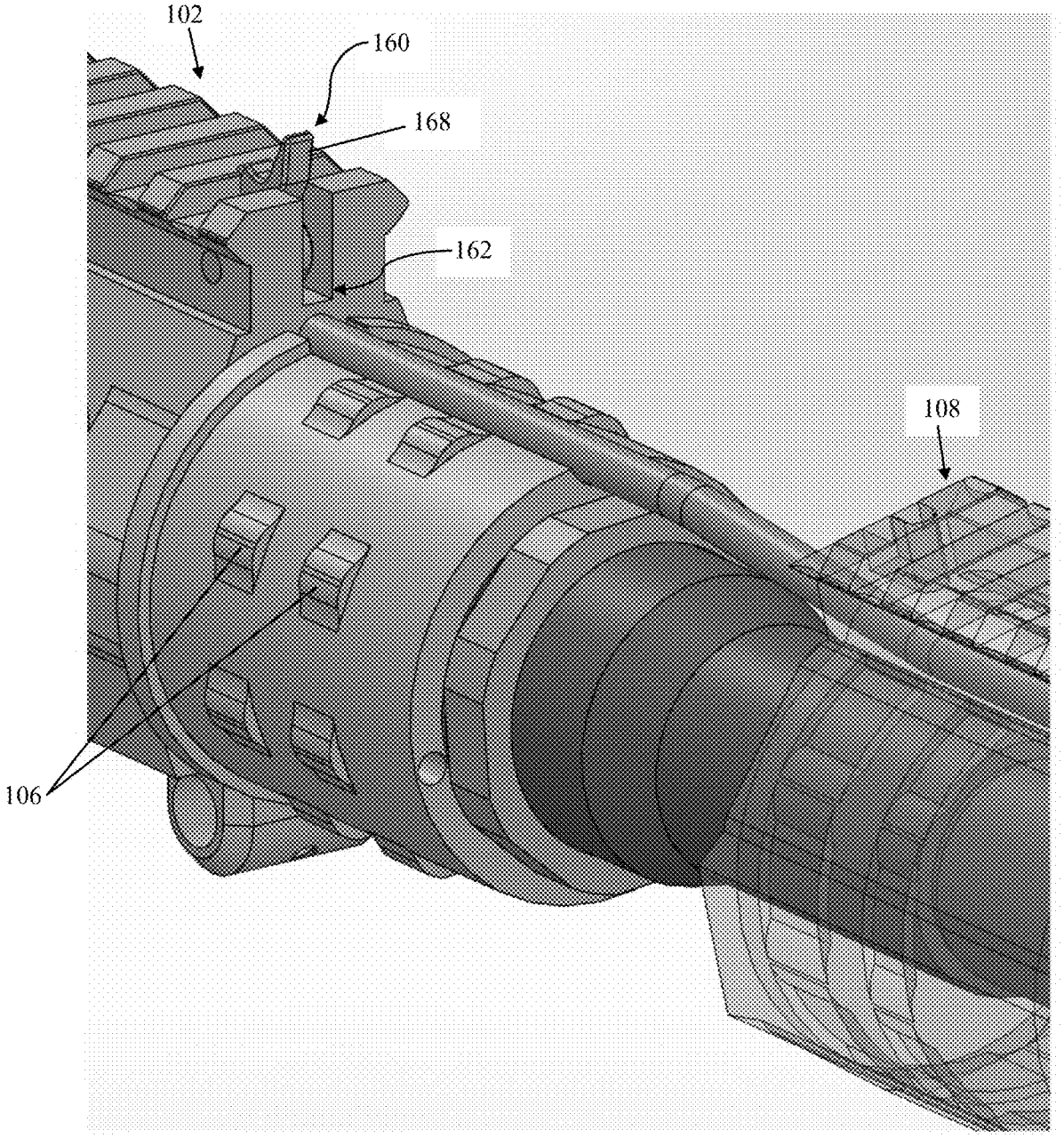
FIG. 14 is an elevated front right side perspective detail view of the objects of FIG. 13 showing the handguard translated longitudinally further forward along the tenon and separated from the receiver.

FIGS. 10-12 depict the handguard mounting system 100 with the latch 160 in the unlocked position and the handguard 108 rotated about the tenon 104 to an intermediate position wherein the handguard lugs 112 do not cooperate with or mechanically engage the tenon lugs 104 to prevent the handguard 108 from being longitudinally displaced along the tenon 104 and thereby removed from the receiver 102. When the handguard 108 is in the intermediate position, the tenon and handguard lugs 106, 112 are aligned with the respective tenon lug and handguard lug keyways 148, 146. More specifically, when the handguard 108 is in the intermediate position, the handguard lug keyways 146 on the tenon 104 align with the handguard lugs 112, and the tenon lug keyways 148 on the handguard 108 align with the tenon lugs 106 of the tenon 104. This allows the handguard 108 to be longitudinally displaced (i.e., linearly moved) along the longitudinal axis 136 of the tenon 104, as the latch 160 will be in the unlocked position (i.e., disengaged from the handguard). The intermediate position of the handguard can also thus be referred to as a lug-keyway alignment position. FIGS. 13-14 illustrate an unlocked and fully disconnected position of the handguard mounting system 100, wherein the handguard 108 is completely disconnected from the receiver 102.

In use, to mount the handguard 108 to the receiver 102, a user inserts the tenon 104 into the open rear end 110 of the handguard 108 while the latch 160 is in the unlocked position. To do this, the handguard lugs 112 and tenon lugs 106 must be respectively aligned with the handguard lug keyways 146 and the tenon lug keyways 148, as best shown in FIG. 11. Once the tenon 104 is received in the open rear end 110 of the handguard 108 with the handguard 108 abutting the receiver body 130, the tenon and handguard lugs 106, 112 will be automatically received within the respective annular channels or gaps 150, 152 so that the handguard 108 can be rotated about the tenon 104. The user then rotationally aligns the tops 132, 142 of the receiver 102 and the handguard 108 by rotating the handguard 108 about the tenon 104. Upon aligning the tops 132, 142 of the receiver 102 and handguard 108, the corresponding slots 162, 164 in each will also become aligned and indexed to one another. This allows the latch 160 to be moved from the unlocked to the locked position. As such, the user then moves the latch from the unlocked to the locked position by pivoting the lever 160 such that the spur 168 becomes seated in the corresponding slot (which can be slot 164 or slot 162, depending on whether the latch 160 is mounted to the receiver 102 or the handguard 108). The handguard 108 will then be rigidly secured to the receiver 102. The handguard 108 is removable from the receiver 102 by reverse operation of the above method steps.

FIGS. 15-18 illustrate another embodiment of a handguard mounting system 100 which is incorporated into a shotgun 116. The handguard mounting system of FIGS. 15-18 is identical to the handguard mounting system of FIGS. 4-14 in all respects except as specifically described hereafter. The tenon lugs 106 and the handguard lugs 112 used in the handguard mounting system 100 on the shotgun 116 are larger in size and more robust in order to resist the greater recoil impulse generated upon discharge of shotgun ammunition. Additionally, the tenon 104 and handguard 108 used in the handguard mounting system 100 on the shotgun 116 omit the gas tube grooves 122, 124 found on the handguard mounting system of FIGS. 4-14.

Although various embodiments have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been particular embodiments described herein, it is not intended that such references be construed as limitations upon the scope of this invention except as set forth in the following claims.

What is claimed is:

1. A handguard mounting system, comprising:

a receiver having a tenon on which is defined a plurality of tenon lugs;

a handguard having an open rear end in which the tenon is receivable and a plurality of handguard lugs on an interior surface of the open rear end; and a latch on one of the handguard or the receiver, the latch configured to selectably deter rotation of the handguard about the tenon when the top of the handguard is rotationally aligned around the tenon with the top of the receiver, wherein the tenon lugs and the handguard lugs cooperate to mount the handguard to the receiver when the tenon is received in the open rear end of the handguard and a top of the handguard is rotationally aligned around the tenon with a top of the receiver.

2. The handguard mounting system of claim 1, wherein:

the handguard lugs and the tenon lugs cooperate to prevent longitudinal movement of the handguard relative to the receiver when the tenon is received in the open rear end of the handguard and the top of the handguard is rotationally aligned around the tenon with the top of the receiver.

3. The handguard mounting system of claim 2, wherein:

the handguard lugs longitudinally overlap the tenon lugs when the tenon is received in the open rear end of the handguard and the top of the handguard is rotationally aligned around the tenon with the top of the receiver.

4. The handguard mounting system of claim 2, wherein:

a forward surface of each handguard lug engages a rear surface of each tenon lug when the tenon is received in the open rear end of the handguard and the top of the handguard is rotationally aligned around the tenon with the top of the receiver.

5. The handguard mounting system of claim 1, wherein:

at least one plurality of the plurality of tenon lugs and the plurality of handguard lugs is configured to bias the handguard into contact with a body of the receiver when the tenon is received in the open rear end of the handguard and the top of the handguard is rotationally aligned around the tenon with the top of the receiver.

6. The handguard mounting system of claim 5, wherein:

at least one plurality of the plurality of tenon lugs and the plurality of handguard lugs is at least partially helical.

7. The handguard mounting system of claim 1, wherein:

the plurality of tenon lugs includes a first row of tenon lugs and a second row of tenon lugs spaced longitudinally rearward on the tenon from the first row of tenon lugs; and the plurality of handguard lugs includes a first row of handguard lugs and a second row of handguard lugs spaced longitudinally forward on the interior surface of the open rear end from the first row of handguard lugs.

8. The handguard mounting system of claim 1, wherein:

each handguard lug of the plurality of handguard lugs extends further around the interior surface of the open rear end of the handguard than each tenon lug of the plurality of tenon lugs extends around the tenon.

9. The handguard mounting system of claim 1, wherein:

the plurality of tenon lugs is spaced circumferentially around and extends radially outward from the tenon; and the plurality of handguard lugs is spaced circumferentially around and protrudes centripetally from the interior surface of the open rear end of the handguard.

10. The handguard mounting system of claim 9, wherein:

the plurality of handguard lugs defines a plurality of tenon lug keyways through which the plurality of tenon lugs is receivable extending longitudinally along the interior surface of the open rear end of the handguard between adjacent handguard lugs of the plurality of handguard lugs; and the plurality of tenon lugs defines a plurality of handguard lug keyways through which the plurality of handguard lugs is receivable extending longitudinally along the tenon between adjacent tenon lugs of the plurality of tenon lugs.

11. The handguard mounting system of claim 1, wherein:

the handguard is rotatable about the tenon in both a clockwise direction and a counterclockwise direction to rotationally align the top of the handguard with the top of the receiver to mount the handguard to the receiver when the tenon is received in the open rear end of the handguard.

12. The handguard mounting system of claim 1, wherein:

the handguard is rotatable about the tenon in only one of a clockwise direction or a counterclockwise direction to rotationally align the top of the handguard with the top of the receiver to mount the handguard to the receiver when the tenon is received in the open rear end of the handguard.

13. The handguard mounting system of claim 1, wherein:

the latch is movable between a locked position wherein the latch engages the other one of the handguard or the receiver to deter rotation of the handguard about the tenon, and an unlocked position wherein the latch does not engage the other one of the handguard or the receiver to deter rotation of the handguard about the tenon.

14. The handguard mounting system of claim 13, wherein:

the latch is configured to remain in the locked position until manually moved to the unlocked position.

15. The handguard mounting system of claim 13, wherein:

the latch is a lever having a body and a spur protruding from the body;

the body is pivotably mounted to the one of the handguard or the receiver; and the other one of the handguard or the receiver defines a slot in which the spur is receivable to deter rotation of the handguard about the tenon when the latch is in the locked position.

16. The handguard mounting system of claim 15, wherein:

the body of the lever defines a camming surface configured to maintain the spur in the slot when the lever is in the locked position until the spur is manually lifted out of the slot to move the lever to the unlocked position.

17. A method of mounting a handguard for a gun to a receiver for the gun, comprising:

providing the receiver and the handguard of claim 1;

inserting the tenon into the open rear end of the handguard; and rotationally aligning the top of the handguard around the tenon with the top of the receiver.

18. A gun comprising the handguard mounting system of claim 1.

19. A handguard mounting system, comprising:

a receiver having a tenon on which is defined a plurality of tenon lugs;

a handguard having an open rear end in which the tenon is receivable and a plurality of handguard lugs on an interior surface of the open rear end, wherein the tenon lugs and the handguard lugs cooperate to prevent longitudinal movement of the handguard relative to the receiver when the tenon is received in the open rear end of the handguard and a top of the handguard is rotationally aligned around the tenon with a top of the receiver; and a latch on one of the handguard or the receiver configured to be selectably engaged with the other one of the handguard or the receiver to deter rotation of the handguard about the tenon when the top of the handguard is rotationally aligned around the tenon with the top of the receiver.

20. A method of mounting a handguard for a gun to a receiver for the gun, comprising:

receiving a handguard mounting system comprising:

a receiver having a tenon on which is defined a plurality of tenon lugs;

a handguard having an open rear end in which the tenon is receivable and a plurality of handguard lugs on an interior surface of the open rear end, wherein the tenon lugs and the handguard lugs cooperate to prevent longitudinal movement of the handguard relative to the receiver when the tenon is received in the open rear end of the handguard and a top of the handguard is rotationally aligned around the tenon with a top of the receiver; and a latch on one of the handguard or the receiver configured to be selectably engaged with the other one of the handguard or the receiver to deter rotation of the handguard about the tenon when the top of the handguard is rotationally aligned around the tenon with the top of the receiver;

inserting the tenon into the open rear end of the handguard;

rotationally aligning the top of the handguard around the tenon with the top of the receiver; and engaging the latch with the other one of the handguard or the receiver.

* * * * *